US011944891B2

(12) United States Patent
Hashimoto

(10) Patent No.: US 11,944,891 B2
(45) Date of Patent: Apr. 2, 2024

(54) SELECTION OF A SPORTS CLUB, RACKET OR BAT USING GROUND PRESSURE FORCES APPLIED BY THE PLAYER IN A STROKE

(71) Applicants: Robert Brodie Lantz, Charlottetown (CA); Terry Glen Hashimoto, Charlottetown (CA)

(72) Inventor: Terry Glen Hashimoto, Charlottetown (CA)

(73) Assignee: Swing Balance LLC, Charlottetown (CA)

( * ) Notice: Subject to any disclaimer, the term of this patent is extended or adjusted under 35 U.S.C. 154(b) by 320 days.

(21) Appl. No.: 17/526,259

(22) Filed: Nov. 15, 2021

(65) Prior Publication Data

US 2023/0149792 A1 May 18, 2023

(51) Int. Cl.

| | |
|---|---|
| ***A63B 71/06*** | (2006.01) |
| *A63B 102/18* | (2015.01) |
| *A63B 102/20* | (2015.01) |
| *A63B 102/24* | (2015.01) |
| *A63B 102/32* | (2015.01) |

(52) U.S. Cl.

CPC .. *A63B 71/0619* (2013.01); *A63B 2071/0694* (2013.01); *A63B 2102/18* (2015.10); *A63B 2102/20* (2015.10); *A63B 2102/24* (2015.10); *A63B 2102/32* (2015.10); *A63B 2220/52* (2013.01); *A63B 2225/02* (2013.01)

(58) Field of Classification Search

CPC ..... A63B 71/0619; A63B 2071/0694; A63B 2102/18; A63B 2102/20; A63B 2102/24; A63B 2102/32; A63B 2220/52; A63B 2225/02; A63B 60/42; A63B 2069/367; A63B 2220/30; A63B 69/0002; A63B 69/3623; A63B 2220/833; A63B 69/0024; A63B 69/3661; A63B 2220/53; A63B 2220/56

USPC ..... 473/151, 199, 219, 257, 258, 249, 452, 473/453

See application file for complete search history.

(56) References Cited

U.S. PATENT DOCUMENTS

| | | | | |
|---|---|---|---|---|
| 6,192,323 | B1 * | 2/2001 | Boehm | A63B 69/3605 702/182 |
| 7,153,215 | B2 * | 12/2006 | Peterson | A63B 53/0466 473/409 |
| 7,887,440 | B2 * | 2/2011 | Wright | A63B 69/3632 473/223 |

(Continued)

*Primary Examiner* — Nini F Legesse

(74) *Attorney, Agent, or Firm* — Adrian D. Battison; Ade & Company Inc.; Ryan W. Dupuis

(57) ABSTRACT

A method for selecting a most suitable golf club from a set, where the shafts of the set are of different levels of flexibility along the shaft, includes using a pressure sensing mat upon which the player places both feet while carrying out a sample swing to measure forces applied by feet of the player during the stroke. The pressure sensing mat provides output signals indicative of vertical forces, lateral forces, both heel to toe and side to side, lateral speed, both heel to toe and side to side applied by the feet of the player during the swing and a processor operating on the signals selects certain ones of the output signals to calculate a load factor from the selected signals which is used to select one of the set most suitable for use by the player using a color coding system applied to the load factor.

21 Claims, 1 Drawing Sheet

(56) References Cited

U.S. PATENT DOCUMENTS

| | | | | |
|---|---|---|---|---|
| 7,946,960 | B2 * | 5/2011 | Vitolo | A61B 5/224 482/8 |
| 8,864,598 | B2 * | 10/2014 | Worobets | A63B 60/42 473/219 |
| 10,709,969 | B2 * | 7/2020 | Sbragia | A63F 13/42 |
| 2011/0230273 | A1 * | 9/2011 | Niegowski | A43B 3/34 473/223 |

* cited by examiner

SELECTION OF A SPORTS CLUB, RACKET OR BAT USING GROUND PRESSURE FORCES APPLIED BY THE PLAYER IN A STROKE

This invention relates to an apparatus or method for use in selection of a sports club, stick, racket or bat or other impact element for a player using ground pressure forces applied by the player during a swing or stroke using the impact element. The invention is particularly applicable to golf, but is also applicable to other impact sports using impact elements such as baseball bats, various rackets for different racket sports, hockey sticks and cricket bats.

Mats or plates for measuring the forces applied to the ground by a player during a playing stroke are available and have been typically used for teaching the player how to change or improve the stroke.

The apparatus herein uses an analysis of certain forces from the stroke to make a selection of an impact element, club or shaft from a set of the elements available to the player.

The same apparatus can be used where the output signals from the mat or plate are used for measuring performance benefits of variable shoe design, the selection of proper shaft grip, glove, etc.

BACKGROUND OF THE INVENTION

The current method for fitting Golf clubs, Baseball or Cricket bats, or Hockey sticks to a player is to measure the speed of the projectile using what is known as a launch monitor and then picking a shaft of the body of the impact element based on estimated profiles.

This is however a crude system based primarily on one parameter which is the speed of the impact element at the impact point which generates a velocity of the game element in the form of the ball, puck or other element.

SUMMARY OF THE INVENTION it is an object of the present invention to provide an improved apparatus or method by which a most suitable impact element such as a club, or the shaft of a club, can be selected for the player.

According to the invention there is provided an apparatus for use in a sporting activity where a game element is impacted by an impact element swung by a player, the apparatus comprising:

- a set of manually operable impact elements for striking the game element in an impact;
- each of the manually operable elements having a shaft or body which flexes throughout the swing, prior to and post impact;
- each one of the set of manually operable elements having a shaft or body which flexes throughout the swing differently from others of the set; a pressure sensing mat or plate upon which the player places both feet while carrying out a sample swing or stroke;
- the pressure sensing mat or plate measuring forces applied by both feet of the player during the stroke and generating output signals dependent on the measured forces;
- and a processor for calculating a selected one of the set most suitable for use by the player depending on the output signals.

Preferably in one embodiment, the pressure sensing mat or plate provides an output signal indicative of vertical forces and lateral forces, both heel to toe and side to side.

Also the output signals include data relating to lateral speed, both heel to toe and side to side applied by the feet of the player during the swing or stroke. The speed can be obtained from a movement of the center or pressure which defines a moving center which can be tracked and its speed of movement tracked in one or more directions.

Preferably in one embodiment, the processor uses an algorithm which uses a combination of selected ones of the above metrics for calculating a selected one of the set most suitable for use by the player, Preferably in one embodiment, the processor uses an algorithm which uses a combination of selected ones of the above metrics to determine a load factor applied on a shaft or body during a swing for use in calculating a selected one of the set most suitable for use by the player, Preferably in one embodiment, the processor uses an algorithm which uses a combination of the following metrics for calculating a selected one of the set most suitable for use by the player.

Total mass applied to the mat by the player during the swing;

Horizontal forces in one or more directions;

Horizontal speed which may be determined from the movement of the center pr pressure;

Vertical forces typically at impact but also optionally at different locations through the swing.

Preferably in one embodiment, the algorithm uses a combination of some or all of the metrics at impact to determine the overall load applied on a shaft or body during a swing. The load factor can be determined at impact or at various positions during the swing.

Preferably in one embodiment, the algorithm uses a combination of some or all of the metrics to calculate a load factor value associated with the player and the swing of the player.

Preferably in one embodiment, the algorithm uses the load factor value to select said one of the set most suitable for use by the player.

Preferably in one embodiment, the mat generates an output related to movement of a center of pressure applied by the feet of the player to the mat.

Preferably in one embodiment, the mat generates an output related to a transition of the weight of the player from one foot to the other during the swing. In some cases this can be done by monitoring the center or pressure.

Preferably in one embodiment, each of the set of manually operable elements has a shaft or body which contains sections along its length with different levels of flexibility between the sections so that the sections of each element of the set are different from the sections of others of the set.

Preferably in one embodiment, each element of the set is provided with a visually distinguishable code or combination of codes so as to distinguish from the other elements of the set and wherein the processor is arranged to provide an output indicative of the code for the selected one of the set most suitable for use by the player depending on the output signals.

Preferably in one embodiment, the visually distinguishable codes comprise a set of different colors.

On that premise, speed of the projectile is an antiquated system in comparison to actually measuring with the ground and an algorithm specifically designed to utilize metrics in the X-Y-Z axes to determine actual load and unload profiles generated during these swing sports swings as correlated to a matrix for proper color code shaft and body type selection"

Many suppliers provide a device for use as a mat in measuring forces applied by a player to the ground during a stroke or swing of a club or bat. One example is Swing Catalyst who have both video and mat mapping systems to analyze a swing of the player such as in golf or baseball.

Some examples of such devices are shown in U.S. Pat. No. 7,946,928 of Mooney U.S. Pat. No. 8,966,997 issued Mar. 3 2015 by Taylor and Published application 2011/0260890 of Initial Force in Norway. The disclosures of each of the above is incorporated herein by reference.

Pressure mats are capable of showing a complete Pressure Mapping Picture of the pressure generated during your golf swing in all directions, Side to Side, Heel to Toe, Down and Up Software systems integrated to pressure mats present unique data during and after each swing. Synchronized video replay allows the player to dissect all aspects of the swing while comparing it to vital measurements such as center of pressure (COP) trace, velocity, and weight distribution.

Such systems can provide various data and for example such as system may provide data on some or all of the following:

COP Center of Pressure (COP) is the Average of all the forces created by gravity between the feet of the player while standing on the sensing mat.

Vertical Force is based on the unit total of 1 when the player stands on the sensing mat the relative downward force generated by each foot and the sum thereof.

Swing Analysis: generates a complete Pressure Mapping Picture of the pressure generated during the golf swing in all directions, Side to Side, Heel to Toe, Down and Up Lead Side: Front Side of the Golfer closest to target Trail Side: Back Side of the Golfer furthest to target Velocity Chart: Speed of COP measured in Lateral, and Heel to Toe motion Vertical Force Chart: Relative value Pressure down during the golfers swing, referred to as Vertical based on the notion that in golf down is up Release Factor: Time from Peak Velocity to Impact Peak Velocity: Point in Time of fastest lateral motion The system can be operated to use the above data to provide the following indications of the characteristics of the swing of the player allowing analysis of the swing which can lead to an improvement:

Scattered Trace: COP Pressure Moves randomly during a golfers swing in all directions Fish Hook Trace: COP Pressure Moves towards the toes in the downswing creating a pattern that looks like a Fish Hook Lateral Trace: COP Pressure Moves straight back then into the toes and or the heels and forms a parallel line towards impact Linear Trace: COP Pressure Moves straight back and through during your swing Abbreviated Trace: COP Pressure Moves back not very far to the Trail Side and then straight through to impact Squirrel Trace: Can be a Lateral and or Linear Trace, but just prior to impact the COP Pressure makes a little circle, going back but then forward again prior to impact Heel to Toe Trace: COP Trace moves straight from the trail side to the lead toe at or near impact Z Trace: COP Trace looks like a Heel to Toe Trace but prior to impact the COP Pressure moves straight back to the trail side Back Up: COP Pressure Moves backwards and stays there prior to impact

BRIEF DESCRIPTION OF THE DRAWINGS

One embodiment of the invention will now be described in conjunction with the accompanying drawings in which.

DETAILED DESCRIPTION

Figure 3:
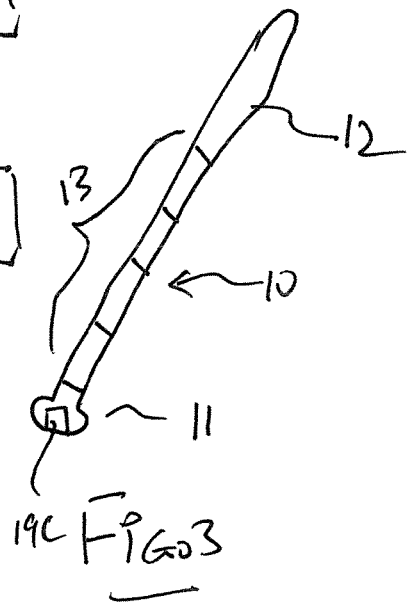
FIG. 3 is an illustration of one club or bat of the set to be selected.

The apparatus for use in a sporting activity includes a game element (not shown) which is impacted by an impact element or club or bat 10 swung by a player. The set of clubs or bats is shown in FIG. 3 where a single one is shown. The clubs or bats are arranged for striking the game element in an impact and include a handle end 11 and a striking end or club head 12.

Each of the clubs has a shaft or body 13 which flexes throughout the swing, prior to and post impact and includes a set of sections 13A, 13B, 13C and 13D which are arranged to have different flexibility profiles and selected so that the flexibility profile of each shaft of the set is different from each of the others. In this way each club and its associated shaft has a characteristic flexibility profile suitable for a player having a characteristic load factor during the swing.

A pressure sensing mat 14 is provided upon which the player places both feet 15 while carrying out a sample swing or stroke. The pressure sensing mat includes a sensor array of the type referenced above measuring forces applied by both feet of the player during the swing or stroke and generating raw data signals from the sensors dependent on the measured forces to a control and analysis processor 16. The processor 16 uses those raw force data signals to calculate output signals indicative of vertical forces, lateral forces, both heel to toe and side to side, lateral speed, both heel to toe and side to side applied by the feet of the player during the swing or stroke.

The output signals of the above parameters are supplied to a processor 18 for calculating a selected club 10 of the set most suitable for use by the player depending on the output signals.

That is, the processor 18 uses an algorithm which uses a combination of selected ones of the output signals for calculating load factor applied to the club or shaft by the player during the stroke and thus a selected one of the set most suitable for use by the player.

Figure 1:
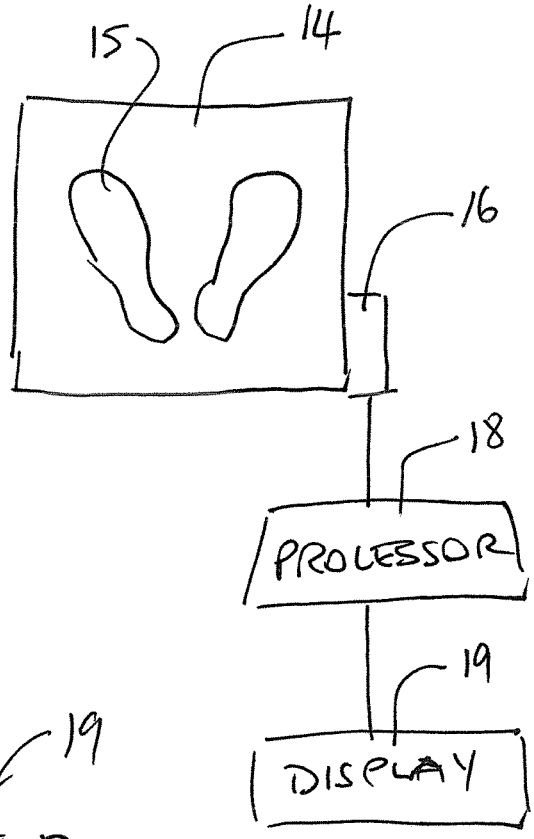
FIG. 1 is a schematic illustration of the system according to the present invention.
Figure 2:
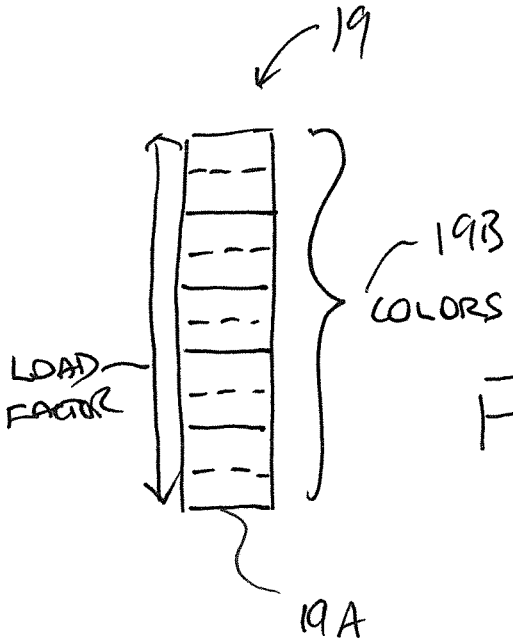
FIG. 2 is a schematic illustration of the display of the apparatus of FIG. 1.

As shown in FIG. 2, a display of the output from the processor 18 is made available to the player at an output display 19. This shows the calculated load factor at the left of a column 19A and shows color codes associated with different load factors at 19B. thus a player after the trial swing or swings is given information relating to the load factor as calculated from the algorithm using the selected ones of the output signals and to the color code associated with that load factor. These color codes are applied to a suitable location on the club 10 so that the player can take the selected club according to the color code.

The selected output signals can use the following:

Total mass applied to the mat by the player during the swing

Horizontal force

Horizontal speed;

Vertical forces at impact

Also the output signals from the mat are used for measuring performance benefits of variable shoe design, the selection of proper shaft grip, glove, etc.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An apparatus for use in a sporting activity where a game element is impacted by a manually operable impact element swung by a player, the apparatus comprising:

a set of the manually operable impact elements for striking the game element in an impact during a swing or stroke;

each of the set of manually operable impact elements having a shaft or body which flexes throughout the swing or stroke, prior to and post impact;

each one of the set of manually operable impact elements having a shaft or body which flexes throughout the swing or stroke differently from others of the set;

a pressure sensing mat or plate upon which the player places both feet while carrying out a sample swing or stroke;

the pressure sensing mat or plate measuring forces applied by both feet of the player during the swing or stroke and generating output signals dependent on the measured forces;

and a processor for calculating a selected one of the set most suitable for use by the player depending on the output signals;

wherein each manually operable impact element of the set is provided with a visually distinguishable code or combination of codes so as to distinguish from said other manually operable impact elements of the set;

and wherein the processor is arranged to provide an output indicative of the code or combination of codes for the selected one of the set most suitable for use by the player depending on the output signals.

2. The apparatus according to claim 1 wherein the pressure sensing mat or plate provides output signals indicative of vertical forces, lateral forces, both heel to toe and side to side and lateral speed applied by the feet of the player during the swing or stroke.

3. The apparatus according to claim 1 wherein the processor uses an algorithm which uses a combination of selected ones of the output signals for calculating a selected one of the set most suitable for use by the player.

4. The apparatus according to claim 1 wherein the processor uses an algorithm which uses a combination of selected ones of the output signals to determine a load factor applied on a shaft or body during the swing or stroke for use in calculating a selected one of the set most suitable for use by the player.

5. The apparatus according to claim 1 wherein the processor uses an algorithm which uses a combination of the following output signals for calculating a selected one of the set most suitable for use by the player;

Total mass applied to the mat by the player during the swing or stroke;

Horizontal forces in one or more directions;

Horizontal speed;

Vertical forces.

6. The apparatus according to claim 5 wherein the algorithm uses a combination of some or all of the output signals at impact to determine the overall load applied on a shaft or body during the swing or stroke.

7. The apparatus according to claim 5 wherein the algorithm uses a combination of some or all of the output signals to calculate a load factor value associated with the player and the swing or stroke of the player.

8. The apparatus according to claim 5 wherein the algorithm uses the load factor value to select said one of the set most suitable for use by the player.

9. The apparatus according to claim 1 wherein the mat generates an output related to a transition of the weight of the player from one foot to the other during the swing or stroke.

10. The apparatus according to claim 1 wherein the mat generates an output related to movement of a center of pressure applied by the feet of the player to the mat during the swing or stroke.

11. The apparatus according to claim 1 wherein each of the set of manually operable impact elements has a shaft or body which contains sections along its length with different levels of flexibility between the sections.

12. The apparatus according to claim 1 wherein each of the set of manually operable impact elements has a shaft or body which contains sections along its length with different levels of flexibility between the sections and wherein the sections of each manually operable impact element of the set are different from the sections of others of the set.

13. The apparatus according to claim 1 wherein the visually distinguishable code or combination of codes comprise a set of different colors.

14. The apparatus according to claim 1 wherein the manually operable impact elements are golf clubs, baseball bats, rackets for a racket sport, hockey sticks or cricket bats.

15. A method for selecting a most suitable manually operable impact element of a set of the manually operable impact elements for use by a player for use in a sporting activity where a game element is impacted by the manually operable impact element swung by a player, where the set includes a plurality of the manually operable impact elements for striking the game element in an impact during a swing or stroke, where each of the manually operable impact elements has a shaft or body which flexes throughout the swing or stroke, prior to and post impact, where each one of the set of manually operable impact elements has a shaft or body which flexes differently from others of the set and wherein each manually operable impact element of the set is provided with a visually distinguishable code or combination of codes so as to distinguish each one of the set which flexes differently from other elements of the set;

the method comprising:

using a pressure sensing mat or plate upon which the player places both feet while carrying out a sample swing or stroke to measure forces applied by both feet of the player during the swing or stroke;

the pressure sensing mat or plate providing output signals indicative of vertical forces, lateral forces, both heel to toe and side to side, lateral speed applied by the feet of the player during the swing or stroke;

selecting certain ones of the output signals to calculate a load factor from the selected signals;

and using the load factor to select one of the set most suitable for use by the player and to provide an output indicative of the code or combination of codes for the selected one of the set most suitable for use by the player.

16. The method according to claim 15 wherein the processor uses an algorithm which uses a combination of the following signals for determining the load factor:

Total mass applied to the mat by the player during the swing or stroke;

Horizontal force;

Horizontal speed;

Vertical forces at impact.

17. The method according to claim 15 wherein the visually distinguishable code or combination of codes comprise a set of different colors.

18. The method according to claim 15 wherein the manually operable impact elements are golf clubs, baseball bats, rackets for a racket sport, hockey sticks or cricket bats.

19. A method for selecting a most suitable manually operable impact element of a set of manually operable impact elements for use by a player for use in a sporting activity where a game element is impacted by the manually operable impact element swung by a player, where the set includes a plurality of the manually operable impact elements for striking the game element in an impact during a swing or stroke, where each of the manually operable impact elements has a shaft or body which flexes throughout the swing, prior to and post impact where each one of the set of manually operable elements has a shaft or body which flexes differently from others of the set and wherein each element of the set is provided with a visually distinguishable code or combination of codes so as to distinguish each one of the set which flexes differently from the other elements of the set;

the method comprising:

using a pressure sensing mat or plate upon which the player places both feet while carrying out a sample swing or stroke to measure forces applied by both feet of the player during the swing or stroke;

the pressure sensing mat or plate measuring forces applied by both feet of the player during the stroke and generating output signals dependent on the measured forces;

and using the output signals to select one of the set most suitable for use by the player and to provide an output indicative of the code or combination of codes for the selected one of the set most suitable for use by the player.

20. The method according to claim 19 wherein the visually distinguishable code or combination of codes comprise a set of different colors.

21. The method according to claim 19 wherein the manually operable impact elements are golf clubs, baseball bats, rackets for a racket sport, hockey sticks or cricket bats.

* * * * *